United States Patent [19]

Kanda et al.

[11] Patent Number: 4,761,396

[45] Date of Patent: Aug. 2, 1988

[54] HEAT-SENSITIVE RECORDING MATERIAL

[75] Inventors: Nobuo Kanda, Hirakata; Kazuko Hirahara, Amagasaki; Mitsuru Kondo, Hyogo, all of Japan

[73] Assignee: Kanzaki Paper Manufacturing Co., Ltd., Tokyo, Japan

[21] Appl. No.: 11,101

[22] Filed: Feb. 5, 1987

[30] Foreign Application Priority Data

Feb. 12, 1986 [JP] Japan ..... 61-28098
Jun. 24, 1986 [JP] Japan ..... 61-147775

[51] Int. Cl.[4] ..... B41M 5/18

[52] U.S. Cl. ..... 503/209; 427/151; 503/208; 503/220; 503/225

[58] Field of Search ..... 427/150–152; 503/208, 209, 216, 217, 218, 225, 221, 220; 428/913

[56] References Cited

U.S. PATENT DOCUMENTS

| | | | |
|---|---|---|---|
| 4,020,056 | 4/1977 | Farber | 260/240 D |
| 4,107,428 | 8/1978 | Farber | 542/437 |
| 4,520,377 | 5/1985 | Iwakura et al. | 503/208 |
| 4,523,205 | 6/1985 | Suzuki et al. | 503/209 |
| 4,580,153 | 4/1986 | Kondo et al. | 503/220 |
| 4,641,160 | 2/1987 | Kondo et al. | 503/220 |

*Primary Examiner*—Bruce H. Hess
*Attorney, Agent, or Firm*—Murray and Whisenhunt

[57] ABSTRACT

In a heat-sensitive recording material comprising a colorless or pale-colored basic dye and an electron accepting reactant material which is reactive with the basic dye to form a color when contacted therewith, and comprising at least one of the specific phthalide derivatives as the basic dye, the heat-sensitive recording material characterized in that at least one compound selected from the group consisting of the specific fluorene derivatives and the specific p-phenylenediamine derivatives is further contained in the recording material.

11 Claims, No Drawings

HEAT-SENSITIVE RECORDING MATERIAL

The present invention relates to a heat-sensitive recording material which has outstanding characteristics for use with optical character- or mark-reading devices having a reading wavelength range over the infrared region.

Various methods are proposed which are adapted to record informations by contacting with use of pressure, heat, electricity, light or like energy a colorless or pale-colored basic dye with an organic or inorganic electron accepting reactant material for a color forming reaction. For example, as described on pages 411 to 421, 463 to 470, vol. 30, 1976 of JAPAN TAPPI by Kondo and Iwasaki, many methods are proposed such as pressure-sentitive manifold sheet, heat-sensitive recording sheet, electrothermal recording sheet, ultrasonic recording sheet, electron ray recording sheet, electrostatic recording sheet, photosensitive recording sheet, photosensitive print material, type ribbon, ball-point pen ink, crayon, stamp ink, etc.

With a trend toward more efficient office work in recent years, optical character-reading devices (OCR, including optical mark-reading devices) are in greatly increasing use for reading the record images on record media. Particularly, optical character-reading devices having a reading wavelength range over the infrared region are in greatly increasing use. For example, POS (point of sales) system draws the attention as a useful means in market in order to rapidly meet consumer's requirements. In the system, the price tag having printed character or bar code is read by OCR, and the printed information is computer-treated at the same time of calculation of price for improving management efficiency. For reading characters are used small and inexpensive devices having a reading wavelength range over the infrared region.

However, the record images (such as black images, blue images, red images, green images, etc.) on the above recording material are legible as a leading color by optical character-reading devices having a reading wavelength range over the visible region (400 to 700 nm), but for optical character-reading devices having a reading wavelength range over the infrared region (700 to 900 nm), such images function as drop-out color irrespective of the color of the image and can not be read by the devices.

Accordingly, U.S. Pat. Nos. 4,020,056 and 4,107,428 propose use of a phthalide derivative having two vinyl linkages as a basic dye used for various recording materials suited to optical character-reading devices which utilize near infrared light.

However, since the heat-sensitive recording material using the phthalide derivative fades in color influenced by humidity, heat and like external environmental conditions, and are apt to produce fogging in the background, the differences in light absorption in the near infrared region become small between the record images and the background. Consequently, it is difficult to read by optical character-reading devices having a reading wavelength range over the near infrared region.

An object of the present invention is to provide a heat-sensitive recording material which is readable by optical character-reading devices having a reading wavelength range over the infrared region, and has preservability of the record images, particularly excellent stability against humidity and heat.

The above and other objects of the invention will become apparent from the following description.

The present invention provides a heat-sensitive recording material comprising a colorless or pale-colored basic dye and an electron accepting reactant material which is reactive with the basic dye to form a color when contacted therewith, and comprising at least one of phthalide derivatives represented by the formula [I] as the basic dye, which is characterized in that at least one compound represented by the formula [II] or [III] is further contained in the recording material.

[I]

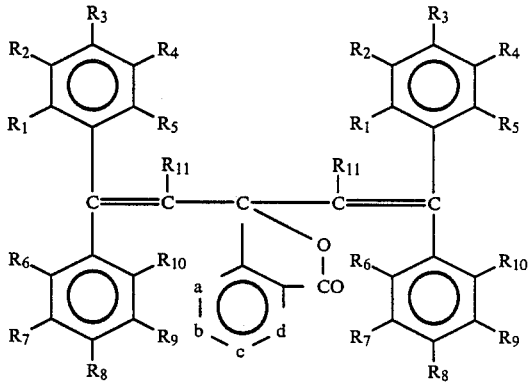

wherein $R_1$ to $R_{10}$ are each hydrogen atom; halogen atom; nitro; substituted or unsubstituted, saturated or unsaturated alkyl; substituted or unsubstituted cycloalkyl; substituted or unsubstituted alkoxyl; substituted or unsubstituted acyloxy; substituted or unsubstituted aryl; substituted or unsubstituted aralkyl; substituted or unsubstituted phenoxy; substituted or unsubstituted thioalkoxyl; or $—N(R_{12})(R_{13})$, $R_{12}$ and $R_{13}$ being each hydrogen atom; substituted or unsubstituted, saturated or unsaturated alkyl; substituted or unsubstituted cycloalkyl; substituted or unsubstituted aryl; substituted or unsubstituted aralkyl; tetrahydrofurfuryl; or substituted or unsubstituted acyl, $R_{12}$ and $R_{13}$ may form a heteroring together therewith or with an adjacent benzene ring, $R_{11}$ is hydrogen atom or lower alkyl, a, b, c and d represent carbon atoms and one or two of them may be nitrogen atom, the carbon atom may have a substituent selected from the group consisting of hydrogen atom; halogen atom; alkyl; alkoxyl; substituted or unsubstituted amino; or nitro, a—b, b—c or c—d bond may form an another aromatic ring,

[II]

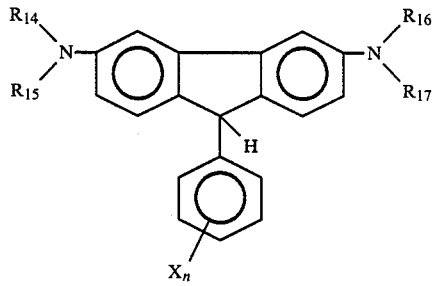

wherein $R_{14}$, $R_{15}$, $R_{16}$ and $R_{17}$ are each $C_1 \sim C_8$ saturated alkyl; $C_5 \sim C_8$ cycloalkyl; $C_3 \sim C_8$ alkoxyalkyl; aryl unsubstituted or substituted with halogen atom, $C_1 \sim C_4$ saturated alkyl or $C_1 \sim C_4$ alkoxyl; or aralkyl unsubstituted or substituted with halogen atom, $C_1 \sim C_4$ saturated alkyl or $C_1 \sim C_4$ alkoxyl; $R_{14}$ and $R_{15}$, or $R_{16}$ and $R_{17}$ may form a heteroring together therewith or with an adjacent benzene ring, X is hydrogen atom; halogen atom; $C_1 \sim C_4$ saturated alkyl; $C_1 \sim C_4$ alkoxyalkyl; or $—N(R_{18})(R_{19})$, $R_{18}$ and $R_{19}$ are each same as $R_{14}$, $R_{15}$, $R_{16}$ or $R_{17}$, n is an integer of 1 to 4,

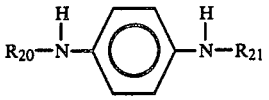

[III]

wherein $R_{20}$ and $R_{21}$ are each $C_1 \sim C_{10}$ saturated alkyl; $C_3 \sim C_9$ unsaturated alkyl; $C_5 \sim C_8$ cycloalkyl; 3-methacryloxy-2-hydroxypropyl; or aralkyl, aryl or arylsulfonyl unsubstituted or substituted with halogen atom, $C_1 \sim C_4$ saturated alkyl or $C_1 \sim C_4$ alkoxyl.

The present heat-sensitive recording material employs a specific phthalide derivative as a basic dye, and a specific fluorene derivative or p-phenylenediamine derivative, and exhibits a remarkably improved preservability of the record images, particularly excellent resistances to heat and humidity. As a result, the record images do not fade in color when exposed to high humidity and high temperature for a long period of time and the heat-sensitive recording material is obtained which exhibits stable light absorption over the infrared region of 700 to 900 nm.

Examples of phthalide derivatives of the formula [I] used in the invention are as follows.

3,3-Bis[1,1-bis(4-dimethylaminophenyl)ethylene-2-yl]-4,5,6,7-tetrachlorophthalide, 3,3-bis[1,1-bis(4-dimethylaminophenyl)ethylene-2-yl]-4,5,6,7-tetrabromophthalide, 3,3-bis[1,1-bis(4-diethylaminophenyl)ethylene-2-yl]-4,5,6,7-tetrachlorophthalide, 3,3-bis[1,1-bis(2-methyl-4-diethylaminophenyl)ethylene-2-yl]-4,5,6,7-tetrachlorophthalide, 3,3-bis[1,1-bis(2-methoxy-4-diethylaminophenyl)ethylene-2-yl]-4,5,6,7-tetrachlorophthalide, 3,3-bis[1,1-bis(4-dimethylaminophenyl)-1-propene-2-yl]-4,5,6,7-tetrachlorophthalide, 3,3-bis[1,1-bis[4-dimethylaminophenyl)ethylene-2-yl]-5-pyrrolidinophthalide, 3,3-bis[1,1-bis(4-dimethylaminophenyl)ethylene-2-yl]-6-pyrrolidinophthalide, 3,3-bis[1,1-bis(4-dimethylaminophenyl)ethylene-2-yl]-5,6-dichlorophthalide, 3,3-bis[1,1-bis(4-dimethylaminophenyl)ethylene-2-yl]phthalide, 3,3-bis[1,1-bis(4-dimethylaminophenyl)ethylene-2-yl]-5-dimethylaminophthalide, 3,3-bis[1,1-bis(4-dimethylaminophenyl)ethylene-2-yl]-6-dimethylaminophthalide, 3,3-bis[1,1-bis(4-dimethylaminophenyl)ethylene-2-yl]-5-nitrophthalide, 3,3-bis[1,1-bis(4-dimethylaminophenyl)ethylene-2-yl]-6-nitrophthalide, 3,3-bis[1,1-bis(4-diethylaminophenyl)ethylene-2-yl]-5-ethoxyphthalide, 3,3-bis[1,1-bis(4-diethylaminophenyl)ethylene-2-yl]-6-ethoxyphthalide, 3,3-bis[1,1-bis(4-dimethylaminophenyl)ethylene-2-yl]-5-methylphthalide, 3,3-bis[1,1-bis(4-dimethylaminophenyl)ethylene-2-yl]-6-methylphthalide, 3,3-bis[1,1-bis(4-N-ethyl-N-benzylaminophenyl)ethylene-2-yl]-4,5,6,7-tetrachlorophthalide, 3,3-bis[1,1-bis(4-N-methyl-N-p-tolylaminophenyl)ethylene-2-yl]-4,5,6,7-tetrachlorophthalide, 3,3-bis[1,1-bis(4-N-ethyl-N-allylaminophenyl)ethylene-2-yl]-4,5,6,7-tetrabromophthalide, 3,3-bis[1,1-bis(4-dipropargylaminophenyl)ethylene-2-yl]-4,5,6,7-tetrachlorophthalide, 3,3-bis[1,1-bis(4-dimethylaminophenyl)ethylene-2-yl]-5,6-benzophthalide, 3,3-bis[1,1-bis(4-dimethylaminophenyl)ethylene-2-yl]-4-azaphthalide, 3,3-bis[1,1-bis(4-dimethylaminophenyl)ethylene-2-yl]-5-azaphthalide, 3,3-bis[1,1-bis(4-dimethylaminophenyl)ethylene-2-yl]-6-azaphthalide, 3,3-bis[1,1-bis(4-dimethylaminophenyl)ethylene-2-yl]-7-azaphthalide, 3,3-bis[1,1-bis(4-dimethylaminophenyl)ethylene-2-yl]-4,7-diazaphthalide, 3,3-bis[1,1-bis(4-dimethylaminophenyl)ethylene-2-yl]-5,6-benzo-4,7-diazaphthalide, 3,3-bis[1,1-bis(4-pyrrolidinophenyl)ethylene-2-yl]phthalide, 3,3-bis[1,1-bis(4-pyrrolidinophenyl)ethylene-2-yl]-4,5,6,7-tetrachlorophthalide, 3,3-bis[1,1-bis[4-pyrrolidinophenyl)ethylene-2-yl]-4,5,6,7-tetrabromophthalide, 3,3-bis[1,1-bis(4-pyrrolidinophenyl)ethylene-2-yl]-5-nitrophthalide, 3,3-bis[1,1-bis(4-pyrrolidinophenyl)ethylene-2-yl]-6-nitrophthalide, 3,3-bis[1,1-bis(4-pyrrolidinophenyl)ethylene-2-yl]-5-ethoxyphthalide, 3,3-bis[1,1-bis(4-pyrrolidinophenyl)ethylene-2-yl]-6-ethoxyphthalide, 3,3-bis[1,1-bis(4-pyrrolidinophenyl)ethylene-2-yl]-5-methylphthalide, 3,3-bis[1,1-bis(4-pyrrolidinophenyl)ethylene-2-yl]-6-methylphthalide, 3,3-bis[1,1-bis(4-pyrrolidinophenyl)ethylene-2-yl]-5-pyrrolidinophthalide, 3,3-bis[1,1-bis(4-pyrrolidinophenyl)ethylene-2-yl]-6-pyrrolidinophthalide, 3,3-bis[1,1-bis(4-pyrrolidinophenyl)ethylene-2-yl]-5,6-dichlorophthalide, 3,3-bis[1,1-bis(4-piperidinophenyl)ethylene-2-yl]phthalide, 3,3-bis[1,1-bis(4-piperidinophenyl)ethylene-2-yl]-5-dimethylaminophthalide, 3,3-bis[1,1-bis(4-piperidinophenyl)ethylene-2-yl]-6-dimethylaminophthalide, 3,3-bis[1,1-bis(4-piperidinophenyl)ethylene-2-yl]-4,5,6,7-tetrachlorophthalide, 3,3-bis[1,1-bis(4-morpholinophenyl)ethylene-2-yl]-4,5,6,7-tetrachlorophthalide, 3,3-bis[1,1-bis(4-hexamethyleneiminophenyl)ethylene-2-yl]-4,5,6,7-tetrachlorophthalide, 3,3-bis[1,1-bis(4-hexamethyleneiminophenyl)ethylene-2-yl]4,5,6,7-tetrabromophthalide, 3,3-bis[1,1-bis(2-methyl-4-pyrrolidinophenyl)ethylene-2-yl]-4,5,6,7-tetrachlorophthalide, 3,3-bis[1,1-bis(2-methoxy-4-pyrrolidinophenyl)ethylene-2-yl]-4,5,6,7-tetrachlorophthalide, 3,3-bis[1,1-bis(4-pyrrolidinophenyl)-1-propene-2-yl]-4,5,6,7-tetrachlorophthalide, 3,3-bis[1,1-bis(1-methyl-1,2,3,4-tetrahydroquinoline-4-yl)ethylene-2-yl]-4,5,6,7-tetrachlorophthalide, 3,3-bis[1,1-bis(1-methyl-1,2,3,4-tetrahydroquinoline-4-yl)ethylene-2-yl]-4,5,6,7-tetrabromophthalide, 3,3-bis[1,1-bis(julolidine-5-yl)ethylene-2-yl]-4,5,6,7-tetrachlorophthalide, 3,3-bis[1,1-bis(julolidine-5-yl)ethylene-2-yl]-4,5,6,7-tetrabromophthalide, 3,3-bis[1,1-bis(4-pyrrolidinophenyl)ethylene-2-yl]-5,6-dichloro-4,7-dibromophthalide, 3,3-bis[1,1-bis(4-pyrrolidinophenyl)ethylene-2-yl]-4,7-dichloro-5,6-dibromophthalide, 3,3-bis[1,1-bis(4-pyrrolidinophenyl)ethylene-2-yl]-5-chloro-4,6,7-tribromophthalide, 3,3-bis[1,1-bis(4-pyrrolidinophenyl)ethylene-2-yl]-6-chloro-4,5,7-tribromophthalide, 3,3-bis[1-(4-ethylphenyl)-1-(4-dimethylaminophenyl)ethylene-2-yl]-4,5,6,7-tetrachlorophthalide, 3,3-bis[1-(4-methylphenyl)-1-(4-pyrrolidinophenyl)ethylene-2-yl]-4,5,6,7-tetrachlorophthalide, 3,3-bis[1-phenyl-1-(4-dibenzylaminophenyl)ethylene-2-yl]-4,5,6,7-tetrachlorophthalide, 3,3-bis[1,1-bis(4-ethoxyphenyl)ethylene-2-yl]-4,5,6,7-tetrabromophthalide, 3,3-bis[1-(4-ethoxyphenyl)-1-(4-methoxyphenyl)ethylene-2-yl]-4,5,6,7-tetrachlorophthalide, 3,3-bis[1-(4-cyclohexylphenyl)-1-(4-pyrrolidinophenyl)ethylene-2-yl]-4,5,6,7-tetrachlorophthalide, 3,3-bis[1-(4-allylphenyl)-1-(4-diethylaminophenyl)ethylene-2-yl]-4,5,6,7-tetrachlorophthalide, 3,3-bis[1-(4-ethoxyphenyl)-1-(2-dimethylaminophenyl)ethylene-2-yl]-4,5,6,7-tetrabromophthalide, 3,3-bis[1-(4-N-tetrahydrofurfuryl-N-methylaminophenyl)-

1-(3-chloro-4-ethoxyphenyl)ethylene-2-yl]-6-chloro-4,5,7-tribromophthalide, 3,3-bis[1-(4-phenoxyethylphenyl)-1-(4-N-methyl-N-ethylaminophenyl)ethylene-2-yl]-5-nitrophthalide, 3,3-bis[1-(4-chlorophenoxyethylphenyl)-1-(4-N-methyl-N-ethylaminophenyl)ethylene-2-yl]-6-nitrophthalide, 3,3-bis[1-(4-N-p-chlorophenyl-N-ethylaminophenyl)-1-(3,4-dimethylphenyl)ethylene-2-yl]-5-ethoxyphthalide, 3,3-bis[1-(4-methoxyphenyl)-1-(4-pyrrolidinophenyl)ethylene-2-yl]phthalide, 3,3-bis[1-(3-nitrophenyl)-1-(3-propargylphenyl)ethylene-2-yl]-4,5,6,7-tetrafluorophthalide, 3,3-bis[1-(4-β-dimethylaminoethylaminophenyl)-1-(3-acetylphenyl)ethylene-2-yl]phthalide, 3,3-bis[1-(4-γ-diethylaminopropylaminophenyl)-1-(3-p-ethylbenzoylphenyl)ethylene-2-yl]-4,5,6,7-tetrachlorophthalide, 3,3-bis[1-(4-p-chlorophenylphenyl)-1-(4-phenethylphenyl)ethylene-2-yl]phthalide, 3,3-bis[1-(2,6-dimethyl-4-tert-butylphenyl)-1-(4-aminophenyl)ethylene-2-yl]-4,5,6,7-tetrabromophthalide, 3,3-bis[1-(4-butoxyphenyl)-1-(4-N-cyclohexyl-N-methylaminophenyl)ethylene-2-yl]-4,5,6,7-tetrabromophthalide, 3,3-bis[1-(2-methyl-4-methylmercaptoethylphenyl)-1-(4-N,N-diallylaminophenyl)ethylene-2-yl]-5,6-dichloro-4,7-dibromophthalide, 3,3-bis[1-(3',3',5'-trimethylcyclohexylphenyl)-1-(N-p-methylphenyl-N-ethylaminophenyl)ethylene-2-yl]-4,5,6,7-tetrabromophthalide, 3,3-bis[1-(2-methyl-4-chloroethoxypropylphenyl)-1-(2,6-diethyl-4-butylphenyl)ethylene-2-yl]-5-chloro-4,6,7-tribromophthalide, 3,3-bis[1-(4-p-methylbenzoyloxyphenyl)-1-(3,5-dimethylphenyl)ethylene-2-yl]-4,5,6-trichlorophthalide, 3,3-bis[1-(4-methylmercaptophenyl)-1-(N-p-toluoylphenyl-N-2-butenylaminophenyl)ethylene-2-yl]-4,5,6-tribromophthalide, 3,3-bis[1-(2-methyl-4-pyrrolidinophenyl)-1-(3-chloro-4-methylphenyl)-1-propene-2-yl]-4,5,6,7-tetrachlorophthalide, 3,3-bis[1-(4-o-methylphenylpropylphenyl)-1-(3-methyl-4-dibutylaminophenyl)-1-butene-2-yl]-4,5,6,7-tetrachlorophthalide, 3,3-bis[1-(3-allyl-4-p-ethylphenoxyethylphenyl)-1-(4-N-ethoxypropyl-N-ethylaminophenyl)ethylene-2-yl]-5,6-dichloro-4,7-dibromophthalide, 3,3-bis[1-(2-methoxy-4-cyclohexylphenyl)-1-(2-ethyl-4-chloroethylmercaptoethylphenyl)ethylene-2-yl]phthalide, 3,3-bis[1-(4-cyclohexylethylphenyl)-1-(N-tetrahydrofurfuryl-N-β-methallylaminophenyl)ethylene-2-yl]-4,5,6,7-tetrachlorophthalide, 3,3-bis[1-(4-3',3'-dimethoxypropylphenyl)-1-(N-p-chlorophenyl-N-isopropylaminophenyl)ethylene-2-yl]-5-ethylphthalide, 3,3-bis[1-(3,5-chloro-4-dimethylaminophenyl)-1-phenylethylene-2-yl]-4,5,6,7-tetrabromophthalide, 3,3-bis[1-(2-propionyl-4-pyrrolidinophenyl)-1-(2-chloro-4-ethoxyphenyl-5-methylphenyl)ethylene-2-yl]-5-butoxyphthalide, 3,3-bis[1-(4-isoamylphenyl)-1-phenylethylene-2-yl]-4-nitrophthalide, 3,3-bis[1-(4-α-naphthylphenyl)-1-(4-N-3'-methylcyclohexyl-N-acetylaminophenyl)ethylene-2-yl]-4-nitrophthalide, 3,3-bis[1-(4-p-dimethylaminophenylphenyl)-1-(4-morpholinophenyl)ethylene-2-yl]-5-diallylaminophthalide, 3,3-bis[1-(4-isopropoxyphenyl)-1-(4-piperazinophenyl)ethylene-2-yl]-4,5,6,7-tetrachlorophthalide, 3,3-bis[1-(4-bromophenyl)-1-(1-methyl-1,2,3,4-tetrahydroquinoline-6-yl)ethylene-2-yl]-4,5,6,7-tetrachlorophthalide, 3,3-bis[1-(4-isopropoxyphenyl)-1-(2,2,4-trimethyl-1,2-dihydroquinoline-6-yl)ethylene-2-yl]-4,5,6,7-tetrachlorophthalide, 3,3-bis[1-(2-acetylamino-4-piperidinophenyl)-1-(2-acetoxy-4-3',5'-dimethylphenoxyphenyl)ethylene-2-yl]phthalide, 3,3-bis[1-phenyl-1-(4-dimethylaminophenyl)ethylene-2-yl]-4,5,6,7-tetrachlorophthalide, 3,3-bis[1-phenyl-1-(4-pyrrolidinophenyl)ethylene-2-yl]-4,5,6,7-tetrachlorophthalide, 3,3-bis[1-(4-methoxyphenyl)-1-(4-dimethylaminophenyl)ethylene-2-yl]-4,5,6,7-tetrachlorophthalide, 3,3-bis[1-(4-ethoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, 3,3-bis[1-(4-phenoxyphenyl)-1-(4-pyrrolidinophenyl)ethylene-2-yl]-4,5,6,7-tetrachlorophthalide, 3,3-bis[1-(4-ethoxyphenyl)-1-(4-diethylaminophenyl)ethylene-2-yl]-4,5,6,7-tetrachlorophthalide, 3,3-bis[1-(4-butoxyphenyl)-1-(4-piperidinophenyl)ethylene-2-yl]-4,5,6,7-tetrachlorophthalide, 3,3-bis[1-(2-methyl-4-methoxyphenyl)-1-(4-diethylaminophenyl)ethylene-2-yl]-4,5,6,7-tetrachlorophthalide, 3,3-bis[1-(2-methyl-4-methoxyphenyl)-1-(4-pyrrolidinophenyl)ethylene-2-yl]-4,5,6,7-tetrachlorophthalide, 3,3-bis[1-(3-chloro-4-ethoxyphenyl)-1-(4-aminophenyl)ethylene-2-yl]-4,5,6,7-tetrachlorophthalide, 3,3-bis[1-(4-methoxyphenyl)-1-(2-methyl-4-pyrrolidinophenyl)ethylene-2-yl]-4,5,6,7-tetrachlorophthalide, 3,3-bis[1-(4-ethoxyphenyl)-1-(3-ethoxy-4-diethylaminophenyl)ethylene-2-yl]-4,5,6,7-tetrachlorophthalide, 3,3-bis[1-(3-methylphenyl)-1-(4-N-methyl-N-benzylaminophenyl)ethylene-2-yl]-4,5,6,7-tetrachlorophthalide, 3,3-bis[1-(3,5-dichlorophenyl)-1-(4-hexamethyleneiminophenyl)ethylene-2-yl]-4,5,6,7-tetrachlorophthalide, 3,3-bis[1-(4-ethoxyphenyl)-1-(4-piperidinophenyl)ethylene-2-yl]-5,6-benzophthalide, 3,3-bis[1-(4-methylphenyl)-1-(julolidine-9-yl)ethylene-2-yl]-4,5,6,7-tetrachlorophthalide, 3,3-bis[1-(4-propoxyphenyl)-1-(3-methyl-4-pyrrolidinophenyl)ethylene-2-yl]-4,7-diazaphthalide, 3,3-bis[1-(4-n-butylphenyl)-1-(4-dimethylaminophenyl)ethylene-2-yl]-5,6-benzo-4,7-diazaphthalide, 3,3-bis[1-(3-ethyl-4-ethoxyphenyl)-1-(4-diethylaminophenyl)ethylene-2-yl]-4-azaphthalide, 3,3-bis[1-(4-ethoxyphenyl)-1-(4-piperidinophenyl)ethylene-2-yl]-5-dibutylaminophthalide, 3,3-bis[1-(4-ethoxyphenyl)-1-(4-piperidinophenyl)ethylene-2-yl]-6-diethylaminophthalide, 3,3-bis[1-(4-methoxyphenyl)-1-(4-dimethylaminophenyl)ethylene-2-yl]-6-pyrrolidinophthalide, 3,3-bis[1-(4-N-methyl-N-β-dimethylaminoethylphenyl)-1-(4-fluorophenyl)ethylene-2-yl]-4-azaphthalide, 3,3-bis[1-(4-N-ethyl-N-β-chloroethylaminophenyl)-1-(4-cyclohexyloxyphenyl)ethylene-2-yl]-4-azaphthalide, 3,3-bis[1,1-bis(4-n-butylphenyl)ethylene-2-yl]-4,5,6,7-tetrachlorophthalide, etc. These phthalide derivatives can be used singly or in mixture thereof.

Among the above phthalide derivatives, the following compound of the formula [IV] is preferable because of its excellent color forming ability and resistance to light.

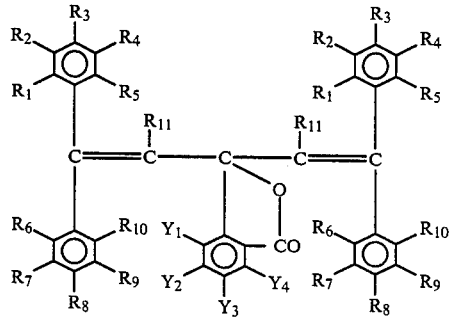

[IV]

wherein $R_1$ to $R_{11}$ are same as above, $Y_1$ to $Y_4$ are each halogen atom.

Further, the following phthalide derivatives of the formulae [V] and [VI] are more preferable since these compounds give excellent color forming ability and resistance to light, and can easily be prepared industrially.

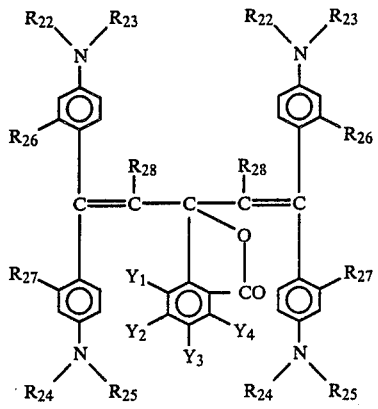

[V]

wherein $R_{22}$ to $R_{25}$ are each $C_1 \sim C_8$ saturated alkyl; $C_3 \sim C_9$ unsaturated alkyl; $C_5 \sim C_7$ cycloalkyl; $C_3 \sim C_8$ alkoxyalkyl; phenyl unsubstituted or substituted with halogen atom, $C_1 \sim C_4$ saturated alkyl or $C_1 \sim C_4$ alkoxyl; or benzyl unsubstituted or substituted with halogen atom, $C_1 \sim C_4$ saturated alkyl or $C_1 \sim C_4$ alkoxyl; $R_{22}$ and $R_{23}$, or $R_{24}$ and $R_{25}$ may form a 5- to 7-membered heteroring together therewith or with an adjacent benzene ring, $R_{26}$ and $R_{27}$ are each hydrogen atom; halogen atom; $C_1 \sim C_4$ saturated alkyl; $C_1 \sim C_4$ alkoxyalkyl; or $C_1 \sim C_4$ acyloxy, $R_{28}$ is hydrogen atom; or $C_1 \sim C_4$ saturated alkyl, $Y_1$ to $Y_4$ are same as above,

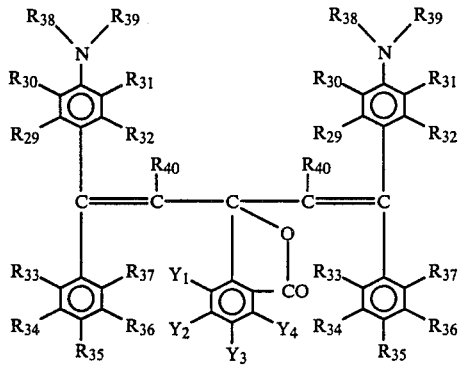

[VI]

wherein $R_{29}$ to $R_{37}$ are each hydrogen atom; halogen atom; nitro; $C_1 \sim C_4$ saturated alkyl; $C_5 \sim C_7$ cycloalkyl; $C_1 \sim C_4$ alkoxyl; $C_1 \sim C_4$ acyloxy; $C_1 \sim C_4$ thioalkoxyl; phenyl unsubstituted or substituted with halogen atom, nitro, methyl, ethyl, methoxy or ethoxy; benzyl unsubstituted or substituted with halogen atom, nitro, methyl, ethyl, methoxy or ethoxy; phenoxy unsubstituted or substituted with halogen atom, nitro, methyl, ethyl, methoxy or ethoxy; benzoyloxy unsubstituted or substituted with halogen atom, nitro, methyl, ethyl, methoxy or ethoxy; $C_1 \sim C_4$ acylamino; or benzoylamino unsubstituted or substituted with halogen atom, nitro, methyl, ethyl, methoxy or ethoxy, $R_{38}$ and $R_{39}$ are each $C_1 \sim C_8$ saturated alkyl; $C_3 \sim C_9$ unsaturated alkyl; $C_5 \sim C_7$ cycloalkyl; $C_3 \sim C_8$ alkoxyalkyl; phenyl unsubstituted or substituted with halogen atom, $C_1 \sim C_4$ saturated alkyl or $C_1 \sim C_4$ alkoxyl; or benzyl unsubstituted or substituted with halogen atom, $C_1 \sim C_4$ saturated alkyl or $C_1 \sim C_4$ alkoxyl; $R_{38}$ and $R_{39}$ may form a 5- to 7-membered heteroring together therewith or with an adjacent benzene ring, $R_{40}$ is hydrogen atom; or $C_1 \sim C_4$ saturated alkyl, $Y_1$ to $Y_4$ are same as above.

The specific fluorene derivative of the formula [II] which is used conjointly with the above phthalide derivative includes 3,6-bis(dimethylamino)-9-(4'-dimethylaminophenyl)fluorene, 3,6-bis(dimethylamino)-9-phenylfluorene, 3,6-bis(dimethylamino)-9-(4'-tolyl)fluorene, 3,6-diamino-9-(4'-aminophenyl)fluorene, 3,6-bis(diethylamino)-9-(4'-diethylaminophenyl)fluorene, 3,6-bis(phenylamino)-9-(4'-phenylaminophenyl)fluorene, 3,6-bis(diethylamino)-9-phenylfluorene, 3,6-bis(diethylamino)-9-(4'-dimethylaminophenyl)fluorene, 3,6-bis(dimethylamino)-9-(4'-diethylaminophenyl)fluorene, 3,6-bis(dimethylamino)-9-(4'-chlorophenyl)fluorene, 3,6-bis(dimethylamino)-9-(4'-methoxyphenyl)fluorene, 3,6-bis(dimethylamino)-9-(4'-ethylephenyl)fluorene, 3,6-bis(N-methyl-N-ethylamino)-9-(4'-dimethylaminophenyl)fluorene, 3,6-bis(dimethylamino)-9-(4'-methylaminophenyl)fluorene, 3,6-bis(N-methyl-N-benzylamino)-9-(4'-dimethylaminophenyl)fluorene, etc. These fluorene derivatives can be used singly or in mixture thereof.

Among the above fluorene derivatives, the following compound of the formula [VII] is preferable because the compound can easily be obtained industrially.

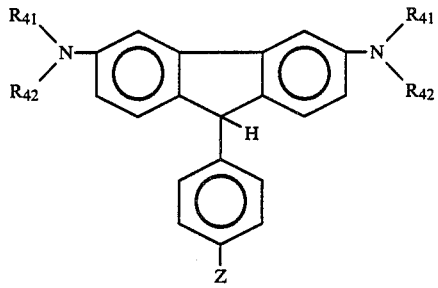

[VII]

wherein $R_{41}$ and $R_{42}$ are each $C_1 \sim C_4$ saturated alkyl, Z is hydrogen atom or $-N(R_{43})(R_{44})$, $R_{43}$ and $R_{44}$ being each $C_1 \sim C_4$ saturated alkyl.

The specific p-phenylenediamine derivative of the formula [III] is used conjointly with the phthalide derivative. Examples thereof are N,N'-di-β-naphthyl-p-phenylenediamine, N-phenyl-N'-cyclohexyl-p-phenylenediamine, N-isopropyl-N'-phenyl-p-phenylenediamine, N,N'-diphenyl-p-phenylenediamine, N,N'-di-o-tolyl-p-phenylenediamine, N,N'-diallyl-p-phenylenediamine, N-(1,3-dimethylbutyl)-N'-phenyl-p-phenylenediamine, N-butyl-N'-phenyl-p-phenylenediamine, N-hexyl-N'-allyl-p-phenylenediamine, N,N'-diisobutyl-p-phenylenediamine, N,N'-diisooctyl-p-phenylenedimaine, N,N'-di(1-ethyl-3-methylpentyl)-p-phenylenediamine, N,N'-di(1,4-dimethylpentyl)-p-phenylenediamine, N,N'-di(1,3-dimethylbutyl)-p-phenylenediamine, N,N'-diisopropyl-p-phenylenediamine, N-phenyl-N'-4-toluenesulfonyl-p-phenylenediamine, N-phenyl-N'-(3-methacryloyloxy-2-hydroxypropyl)-p-phenylenediamine, etc.

These p-phenylenediamine derivatives can be used singly or in mixture thereof. Among these various p-phenylenediamine derivatives, a p-phenylenediamine derivative of the formula [VIII], especially N,N'-di-β-naphthyl-p-phenylenediamine is preferably used, since it causes no coloration or color change and achieves an excellent effect of the invention more efficiently.

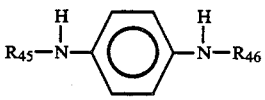

[VIII]

wherein $R_{45}$ and $R_{46}$ are each phenyl or naphthyl unsubstituted or substituted with halogen atom, $C_1 \sim C_4$ saturated alkyl or $C_1 \sim C_4$ alkoxyl.

It is also found that the above specific fluorene derivative and p-phenylenediamine derivative of the invention improve resistance to plasticizer (stability to plasticizer) of the record images, when conjointly used with the specific phthalide derivative of the invention.

In the present heat-sensitive recording material, the above specific phthalide derivative is used in combination with the fluorene derivative or p-phenylenediamine derivative, but as required, various basic dyes can be used conjointly. Examples thereof are shown below.

Triarylmethane lactones, e.g., 3,3-bis(p-dimethylaminophenyl)-6-dimethylaminophthalide, 3-(p-dibenzylaminophenyl)-3-(1,2-dimethylindole-3-yl)-7-azaphthalide, 3-(4-diethylamino-2-ethoxyphenyl)-3-(1-ethyl-2-methylindole-3-yl)-7-azaphthalide, 3,3-bis(1-ethyl-2-methylindole-3-yl)phthalide, etc.

Fluorans, e.g., 3-diethylamino-6-methylfluoran, 3-diethylamino-6-methyl-7-chlorofuran, 3-(N-ethyl-N-p-tolylamino)-7-methylfluoran, 3-diethylamino-6-methyl-7-anilinofluoran, 3-(N-ethyl-N-isopentylamino)-6-methyl-7-anilinofluoran, 3-(N-ethyl-N-tetrahydrofurfurylamino)-6-methyl-7-anilinofluoran, 3-(N-cyclohexyl-N-methylamino)-6-methyl-7-anilinofluoran, 3-(N-ethyl-N-p-tolylamino)-6-methyl-7-anilinofluoran, 3-diethylamino-6-chloro-7-anilinofluoran, 3-dibutylamino-7-o-chloroanilinofluoran, 3-butylamino-7-o-fluoroanilinofluoran, 3-(N-cyclopentyl-N-ethylamino)-6-methyl-7-anilinofluoran, 3-chloro-6-(p-phenylaminophenylamino)fluoran, 2-methyl-3-chloro-6-(p-phenylaminophenylamino)fluoran, 6-(p-phenylaminophenylamino)-1,2-benzofluoran, etc.

Spiropyrans, e.g., di-$\beta$-naphthospiropyran, 3-methyl-di-$\beta$-naphthospiropyran, etc.

Diphenylmethanes, e.g., 4,4'-bis-dimethylaminobenzhydryl benzyl ether, 4,4'-bis-dimethylaminobenzhydryl-p-toluenesulfinate, etc.

Azines, e.g., 3,7-bis(dimethylamino)-10-benzoylphenothiazine, 3,7-bis(diethylamino)-10-benzoylphenoxazine, etc.

Triarylmethanes, e.g., N-butyl-3-[bis{4-(N-methylanilino)phenyl}methyl]carbazole, etc.

In the present heat-sensitive recording material, substances which function as Brnsted acid or Lewis acid are preferably used as an electron accepting reactant material in combination with the above basic dye. Examples thereof are inorganic color acceptor such as acid clay, activated clay, attapulgite, bentonite, colloidal silica, aluminum silicate, magnesium silicate, zinc silicate, tin silicate, calcined kaolin, talc, etc.; organic color acceptor such as oxalic acid, maleic acid, tartaric acid, citric acid, succinic acid, stearic acid and like aliphatic carboxylic acids, benzoic acid, p-tert-butylbenzoic acid, phthalic acid, gallic acid, salicylic acid, 3-isopropylsalicylic acid, 3-phenylsalicylic acid, 3-cyclohexylsalicylic acid, 3,5-di-tert-butylsalicylic acid, 3-methyl-5-benzylsalicylic acid, 3-phenyl-5-($\alpha$,$\alpha$-dimethylbenzyl)salicylic acid, 3,5-di-($\alpha$-methylbenzyl)salicylic acid, 2-hydroxy-1-benzyl-3-naphthoic acid, tetrachlorophthalic acid monoethyl ether and like aromatic carboxylic acids, 4,4'-isopropylidenediphenol, 4,4'-isopropylidenebis(2-chlorophenol), 4,4'-isopropylidene-bis(2,6-dichlorophenol), 4,4'-isopropylidenebis(2,6-dibromophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, $\alpha$-naphthol, $\beta$-naphthol, methyl 4-hydroxybenzoate, benzyl 4-hydroxybenzoate, 2,2'-thiobis(4,6-dichlorophenol), 4-tert-octylcatechol, 2,2'-methylenebis-(4-chlorophenol), 2,2'-methylenebis(4-methyl-6-tert-butylphenol), 2,2'-dihydroxydiphenyl, 4-hydroxydiphenylsulfone, 4-hydroxy-4'-methyl-diphenylsulfone, 4-hydroxy-4'-isopropoxy-diphenylsulfone and like phenolic compounds, p-phenylphenol-formalin resin, p-butylphenolacetylene resin and like phenolic resins; salts of the organic color acceptor with a metal such as zinc, magnesium, aluminum, calcium, titanium, manganese, tin, nickel or like polyvalent metal; 1,3-diphenyl-2-thiourea; 1,3-dichlorophenyl-2-thiourea and like thiourea compounds; etc.

The present heat-sensitive recording material will be explained in more detail below. Various kinds of heat-sensitive recording materials are disclosed, for example, in Japanese examined patent publication Nos. 3,680/1969, 27,880/1969, 14,039/1970, 43,830/1973, 69/1974, 70/1974, 20,142/1977, etc. The present invention can be applied to these various kinds of heat-sensitive recording materials, and provides the heat-sensitive recording material which gives the record image having the afore-mentioned excellent characteristics.

Generally, to a medium having dissolved or dispersed therein a binder were added the phthalide derivative of the formula [I], the compound of the formula [II] or the compound of the formula [III] and further fine particles of the electron accepting reactant material (color acceptor) to obtain a coating composition. The composition is applied to a suitable substrate such as a paper, plastic film, synthetic paper, non-woven sheet, molding to prepare the present heat-sensitive recording material.

The proportions of the basic dye and the color acceptor in the recording layer are not limitative but are usually 1 to 50 parts by weight, preferably 1.5 to 20 parts by weight, more preferably 2 to 10 parts by weight of the latter per one part by weight of the former.

Further, the amount of the compound of the formula [II] or [III] to be used is not limitative but is usually 0.05 to 10 parts by weight, preferably 0.1 to 3 parts by weight of the compound of [II] or [III] per one part by weight of the phthalide derivative of the formula [I]. When less than 0.05 part by weight, the present effect is not obtained sufficiently, with more than 10 parts by weight, the recording layer colors with a lapse of time. Thus, the above range is preferable.

In order to improve color forming ability, can be added to the coating composition various known heat-fusible compounds such as stearic acid amide, stearic acid methylenebisamide, oleic acid amide, palmitic acid amide, coconut fatty acid amide and like aliphatic acid amide; 2,2'-methylene-bis(4-methyl-6-tert-butylphenol), 1,1,3-tris(2-methyl-4-hydroxy-5-tert-butylphenyl)butane and like hindered phenols; 1,2-bis(phenoxy)ethane, 1,2-bis(4-methylphenoxy)ethane, 1,2-bis(3-methyl-phenoxy)ethane, 2-naphthol benzyl ether and like ethers; dibenzyl terephthalate, 1-hydroxy-2-naphthoic acid phenyl ester and like ester; 2-(2'-hydroxy-5'-methylphenyl)benzotriazole, 2-(2'-hydroxy-3+,5'-di-tert-butylphenyl)benzotriazole and like benzotriazoles; etc. The amount of the heat-fusible compound is not limitative but is usually 0.5 to 5 parts by weight of the compound per one part by weight of the basic dye.

Further, in order to take off the luster of the surface of the recording layer or enhance the writing ability, inorganic metal compound such as oxides, hydroxides or carbonates of polyvalent metals, or inorganic pigment is used conjointly in an amount of 0.1 to 5 parts by weight, preferably 0.2 to 2 parts by weight per one part by weight of the color acceptor. Further, as required, various auxiliary agents are usable such as a dispersing agent, ultraviolet ray absorbing agent, defoaming agent, fluorescent dye, coloring dye, etc.

As described above, the present heat-sensitive recording material is prepared by applying to a substrate a coating composition having dispersed therein fine particles of the basic dye, color acceptor and the compounds of the formula [II] or [III]. Alternatively, a coating composition having dispersed one or two of the above components, and another coating composition having dispersed the remaining component or components are applied to a substrate one upon another. Further, the coating composition can be applied to a substrate by impregnation.

The method of preparing a coating composition and coating method are not particularly limited and the coating composition is applied in an amount of usually 2 to 12 g/m$^2$ based on dry weight. It is possible to form an overcoat layer on the recording layer in order to protect the recording layer or to form an under layer on a substrate. Further, various known techniques in the field of the heat-sensitive recording material are usable.

As a binder are used starches, celluloses, proteins, gum arabic, polyvinyl alcohol, styrene-maleic anhydride copolymer salt, styrene-butadiene copolymer emulsion, vinyl acetate-maleic anhydride copolymer salt, polyacrylic acid salt, etc. The amount of the binder used is 10 to 40% by weight, preferably 15 to 30% by weight, based on the weight of total solids content of the coating composition.

The invention will be described below in more detail with reference to Examples without limiting the scope thereof so far as not beyond the spirit of the invention. In the Examples, parts and percentages are all by weight, unless otherwise specified.

EXAMPLE 1

(1) Composition (A)

3,3-Bis[1,1-bis(4-pyrrolidinophenyl)ethylene-2-yl]-4,5,6,7-tetrachlorophthalide (3 parts), 10 parts of 3-(N-cyclohexyl-N-methylamino)-6-methyl-7-anilino-fluoran, 5 parts of 5% aqueous solution of methyl cellulose and 40 parts of water were pulverized by a sand mill to prepare Composition (A) having an average particle size of 3 μm.

(2) Composition (B)

4,4-Cyclohexylidenebisphenol (20 parts), 5 parts of 5% aqueous solution of methyl cellulose and 55 parts of water were pulverized by a sand mill to prepare Composition (B) having an average particle size of 3 μm.

(3) Composition (C)

Stearic acid amide (20 parts), one part of N,N'-diphenyl-p-phenylenediamine, 5 parts of 5% aqueous solution of methyl cellulose and 55 parts of water were pulverized by a sand mill to prepare Composition (C) having an average particle size of 3 μm. (4) Preparation of a recording layer A 58-part quantity of Composition (A), 80 parts of Composition (B), 81 parts of Composition (C), 15 parts of finely divided anhydrous silica (oil absorption 180 ml/100 g), 50 parts of 20% aqueous solution of oxidized starch and 10 parts of water were mixed with stirring to prepare a coating composition. The coating composition was applied to a paper substrate weighing 100 g/m$^2$ in an amount of 5 g/m$^2$ by dry weight to prepare a heat-sensitive recording paper.

EXAMPLE 2

A heat-sensitive recording paper was prepared in the same manner as in Example 1 except that one part of N,N'-di-β-naphthyl-p-phenylenediamine was used in place of one part of N,N'-diphenyl-p-phenylenediamine.

EXAMPLE 3

A heat-sensitive recording paper was prepared in the same manner as in Example 1 except that one part of 3,6-bis(dimethylamino)-9-(4'-dimethylaminophenyl)-fluorene was used in place of one part of N,N'-diphenyl-p-phenylenediamine.

EXAMPLE 4

A heat-sensitive recording paper was prepared in the same manner as in Example 2 except that 3 parts of 3,3-bis[1,1-bis(4-pyrrolidinophenyl)ethylene-2-yl]-5-chloro-4,6,7-tribromophthalide was used in place of 3 parts of 3,3-bis[1,1-bis(4-pyrrolidinophenyl)ethylene-2-yl]-4,5,6,7-tetrachlorophthalide.

EXAMPLE 5

A heat-sensitive recording paper was prepared in the same manner as in Example 3 except that 3 parts of 3,3-bis[1,1-bis(4-dimethylaminophenyl)ethylene-2-yl]-4,5,6,7-tetrachlorophthalide was used in place of 3 parts of 3,3-bis[1,1-bis(4-pyrrolidinophenyl)ethylene-2-yl]-4,5,6,7-tetrachlorophthalide.

EXAMPLE 6

A heat-sensitive recording paper was prepared in the same manner as in Example 1 except that 3 parts of N,N'-di-β-naphthyl-p-phenylenediamine was used in place of one part of N,N'-diphenyl-p-phenylenediamine.

EXAMPLE 7

A heat-sensitive recording paper was prepared in the same manner as in Example 1 except that 3 parts of 3,6-bis(dimethylamino)-9-phenylfluorene was used in place of one part of N,N'-diphenyl-p-phenylenediamine.

EXAMPLE 8

A heat-sensitive recording paper was prepared in the same manner as in Example 1 except that 10 parts of 3-(N-cyclohexyl-N-methylamino)-6-methyl-7-anilino-fluoran was not used.

EXAMPLE 9

A heat-sensitive recording paper was prepared in the same manner as in Example 6 except that 3 parts of 3,3-bis[1,1-bis(4-pyrrolidinopheny)ethylene-2-yl]-

4,5,6,7-tetrabromophthalide was used in place of 3 parts of 3,3-bis[1,1-bis(4-pyrrolidinophenyl)ethylene-2-yl]-4,5,6,7-tetrachlorophthalide.

EXAMPLE 10

A heat-sensitive recording paper was prepared in the same manner as in Example 1 except that 9 parts of N,N'-di-β-naphthyl-p-phenylenediamine was used in place of one part of N,N'-diphenyl-p-phenylenediamine.

EXAMPLE 11

A heat-sensitive recording paper was prepared in the same manner as in Example 1 except that one part of N-phenyl-N'-4-toluenesulfonyl-p-phenylenediamine was used in place of one part of N,N'-diphenyl-p-phenylenediamine.

EXAMPLE 12

A heat-sensitive recording paper was prepared in the same manner as in Example 1 except that one part of N-phenyl-N'-isopropyl-p-phenylenediamine was used in place of one part of N,N'-diphenyl-p-phenylenediamine.

EXAMPLE 13

A heat-sensitive recording paper was prepared in the same manner as in Example 1 except that one part of N-phenyl-N'-cyclohexyl-p-phenylenediamine was used in place of one part of N,N'-diphenyl-p-phenylenediamine.

EXAMPLE 14

A heat-sensitive recording paper was prepared in the same manner as in Example 2 except that 20 parts of 4,4'-isopropylidenediphenol was used in place of 20 parts of 4,4'-cyclohexylidenebisphenol.

COMPARISON EXAMPLE 1

A heat-sensitive recording paper was prepared in the same manner as in Example 1 except that one part of N,N'-diphenyl-p-phenylenediamine was not used.

COMPARISON EXAMPLE 2

A heat-sensitive recording paper was prepared in the same manner as in Example 8 except that one part of N,N'-diphenyl-p-phenylendiamine was not used.

COMPARISON EXAMPLE 3

A heat-sensitive recording paper was prepared in the same manner as in Example 14 except that one part of N,N'-di-β-naphthyl-p-phenylenediamine was not used.

The obtained seventeen kinds of the heat-sensitive recording papers were checked for quality and the results were given in Table 1. [Color forming ability over the near infrared region]

The recording paper was pressed to a plate heated at 120° C. at a pressure of 4 kg/cm$^2$ for 5 seconds to produce record images. The record images and the background area thereof were checked for reflectivity (%) at 830 nm with use of a spectrophotometer to obtain PCS (Print Contrast Signal) value.

PCS value is one of indices exhibiting record density of the record images and is calculated by the following equation.

$$PCS \text{ value} = \frac{A - B}{A}$$

A; reflectivity of the background area

B; reflectivity of the recorded (colored) area

PCS value required for the record images is not determined depending on the kinds of optical character-reading device, but is usually 0.7 to 1.0, preferably 0.75 to 1.0 in the reading wavelength range. [Resistance to humidity over the near infrared region]

The recording paper obtained after tested in the above color forming ability was allowed to stand at 40° C., 90% RH for 24 hours. Thereafter PCS value was calculated similarly to the above. [Resistance to heat over the near infrared region]

The recording paper obtained after tested in the above color forming ability was allowed to stand at 60° C. for 24 hours. Thereafter PCS valve was calculated similarly to the above.

TABLE 1

| | Color forming ability | Resistance to humidity | Resistance to heat |
|---|---|---|---|
| Example | | | |
| 1 | 0.839 | 0.841 | 0.815 |
| 2 | 0.842 | 0.845 | 0.836 |
| 3 | 0.832 | 0.842 | 0.826 |
| 4 | 0.840 | 0.839 | 0.810 |
| 5 | 0.839 | 0.837 | 0.811 |
| 6 | 0.841 | 0.838 | 0.836 |
| 7 | 0.851 | 0.860 | 0.844 |
| 8 | 0.841 | 0.811 | 0.800 |
| 9 | 0.837 | 0.840 | 0.814 |
| 10 | 0.838 | 0.835 | 0.827 |
| 11 | 0.838 | 0.842 | 0.813 |
| 12 | 0.839 | 0.839 | 0.817 |
| 13 | 0.837 | 0.840 | 0.816 |
| 14 | 0.850 | 0.838 | 0.822 |
| Com. Ex. | | | |
| 1 | 0.838 | 0.633 | 0.557 |
| 2 | 0.839 | 0.572 | 0.492 |
| 3 | 0.852 | 0.617 | 0.530 |

EXAMPLE 15

(1) Composition (D)

3,3-Bis[1-(4-methoxyphenyl)-1-(4-pyrrolidinophenyl-)ethylene-2-yl]-4,5,6,7-tetrachlorophthalide (10 parts), 5 parts of 5% aqueous solution of methyl cellulose and 40 parts of water were pulverized by a sand mill to prepare Composition (D) having an average particle size of 3 μm.

(2) Preparation of a recording layer

A 55-part quantity of Composition (D), 80 parts of Composition (B), 81 parts of Composition (C), 15 parts of finely divided anhydrous silica (oil absorption 180 ml/100 g), 50 parts of 20% aqueous solution of oxidized starch and 10 parts of water were mixed with stirring to prepare a coating composition. The coating composition was applied to a paper substrate weighting 100 g/m$^2$ in an amount of 5 g/m$^2$ by dry weight to prepare a heat-sensitive recording paper.

EXAMPLE 16

A heat-sensitive recording paper was prepared in the same manner as in Example 15 except that one part of N,N'-di-β-naphthyl-p-phenylenediamine was used in place of one part of N,N'-diphenyl-p-phenylenediamine.

EXAMPLE 17

A heat-sensitive recording paper was prepared in the same manner as in Example 15 except that one part of N,N'-di-tolyl-p-phenylenediamine was used in place of one part of N,N'-diphenyl-p-phenylendiamine.

EXAMPLE 18

A heat-sensitive recording paper was prepared in the same manner as in Example 16 except that 10 parts of 3,3-bis[1-(4-methoxyphenyl)-1-(4-dimethylamino-phenyl)ethylene-2-yl]-4,5,6,7-tetrachlorophthalide was used in place of 10 parts of 3,3-bis[1-(4-methoxyphenyl)-1-(4-pyrrolidinophenyl)ethylene-2-yl]-4,5,6,7-tetrachlorophthalide.

EXAMPLE 19

A heat-sensitive recording paper was prepared in the same manner as in Example 16 except that 10 parts of 3,3-bis[1-(4-methoxyphenyl)-1-(4-pyrrolidinophenyl-)ethylene-2-yl]-4,5,6,7-tetrabromophthalide was used in place of 10 parts of 3,3-bis[1-(4-methoxyphenyl)-1-(4-pyrrolidinophenyl)ethylene-2-yl]-4,5,6,7-tetrachlorophthalide.

EXAMPLE 20

A heat-sensitive recording paper was prepared in the same manner as in Example 15 except that 3 parts of N,N'-di-β-naphthyl-p-phenylenediamine was used in place of one part of N,N'-diphenyl-p-phenylenediamine.

EXAMPLE 21

(1) Composition (E)

3-(N-Cyclohexyl-N-methylamino)-6-methyl-7-anilinofluoran (10 parts), 5 parts of 5% aqueous solution of methyl cellulose and 40 parts of water were pulverized by a sand mill to prepare Composition (E) having an average particle size of 3 μm.

(2) Preparation of a recording layer

A 18.3-part quantity of Composition (D), 80 parts of Composition (B), 81 parts of Composition (C), 55 parts of Composition (E), 15 parts of finely divided anhydrous silica (oil absorption 180 ml/100 g), 50 parts of 20% aqueous solution of oxidized starch and 10 parts of water were mixed with stirring to prepare a coating composition. The coating composition was applied to a paper substrate weighing 100 g/m$^2$ in an amount of 5 g/m$^2$ by dry weight to prepare a heat-sensitive recording paper.

EXAMPLE 22

A heat-sensitive recording paper was prepared in the same manner as in Example 21 except that one part of N,N'-di-β-naphthyl-p-phenylenediamine was used in place of one part of N,N'-diphenyl-p-phenylenediamine.

EXAMPLE 23

A heat-sensitive recording paper was prepared in the same manner as in Example 22 except that 10 parts of 3,3-bis[1-phenyl-1-(4-hexamethyleneiminophenyl)ethylene-2-yl]-4,5,6,7-tetrachlorophthalide was used in place of 10 parts of 3,3-bis[1-(4-methoxyphenyl)-1-(4-pyrrolidinophenyl)ethylene-2-yl]-4,5,6,7-tetrachlorophthalide.

EXAMPLE 24

A heat-sensitive recording paper was prepared in the same manner as in Example 22 except that 10 parts of 3,3-bis[1-phenyl-1-(4-pyrrolidinophenyl)ethylene-2-yl]-4,5,6,7-tetrachlorophthalide was used in place of 10 parts of 3,3-bis[1-(4-methoxyphenyl)-1-(4-pyrrolidinophenyl)ethylene-2-yl]-4,5,6,7-tetrachlorophthalide.

COMPARISON EXAMPLE 4

A heat-sensitive recording paper was prepared in the same manner as in Example 15 except that one part of N,N'-diphenyl-p-phenylenediamine was not used.

COMPARISON EXAMPLE 5

A heat-sensitive recording paper was prepared in the same manner as in Example 21 except that one part of N,N'-diphenyl-p-phenylenediamine was not used.

The obtained twelve kinds of the heat-sensitive recording papers were checked for quality according to the afore-mentioned methods and the results were given in Table 2.

TABLE 2

| | Color forming ability | Resistance to humidity | Resistance to heat |
|---|---|---|---|
| Example | | | |
| 15 | 0.902 | 0.831 | 0.819 |
| 16 | 0.892 | 0.870 | 0.860 |
| 17 | 0.901 | 0.855 | 0.823 |
| 18 | 0.893 | 0.869 | 0.858 |
| 19 | 0.894 | 0.874 | 0.862 |
| 20 | 0.897 | 0.882 | 0.878 |
| 21 | 0.863 | 0.802 | 0.793 |
| 22 | 0.864 | 0.815 | 0.804 |
| 23 | 0.893 | 0.821 | 0.807 |
| 24 | 0.886 | 0.805 | 0.791 |
| Com. Ex. | | | |
| 4 | 0.900 | 0.621 | 0.538 |
| 5 | 0.861 | 0.574 | 0.486 |

As apparent from the results in Examples, the present heat-sensitive recording material can be applied to optical character-reading device having a reading wavelength range over the infrared region. The obtained record images have excellent resistances to humidity and heat, do not fade by external environmental conditions such as humidity, heat, etc., are excellent in preservability and are high in commercial value.

We claim:

1. In a heat-sensitive recording material comprising a colorless or pale-colored basic dye and an electron accepting reactant material which is reactive with the basic dye to form a color when contacted therewith, and comprising at least one of phthalide derivatives represented by the formula [I] as the basic dye, the heat-sensitive recording material characterized in that at least one compound selected from the group consisting of a fluorene derivative of the formula [II] and a p-phenylenediamine derivative of the formula [III] is further contained in the recording material.

[I]

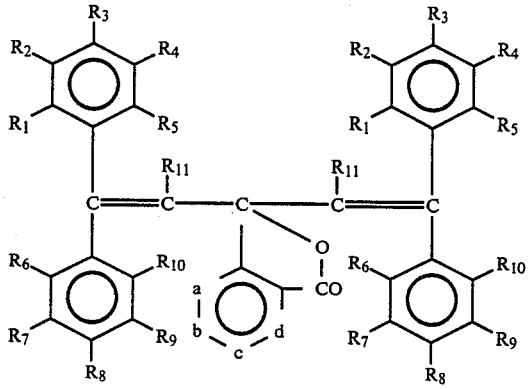

wherein $R_1$ to $R_{10}$ are each hydrogen atom; halogen atom; nitro; substituted or unsubstituted, saturated or unsaturated alkyl; substituted or unsubstituted cycloalkyl; substituted or unsubstituted alkoxyl; substituted or unsubstituted acyloxy; substituted or unsubstituted aryl; substituted or unsubstituted aralkyl; substituted or unsubstituted phenoxy; substituted or unsubstituted thioalkoxyl; or $—N(R_{12})(R_{13})$, $R_{12}$ and $R_{13}$ being each hydrogen atom; substituted or unsubstituted, saturated or unsaturated alkyl; substituted or unsubstituted cycloalkyl; substituted or unsubstituted aryl; substituted or unsubstituted aralkyl; tetrahydrofurfuryl; or substituted or unsubstituted acyl, $R_{12}$ and $R_{13}$ may form a heteroring together therewith or with an adjacent benzene ring, $R_{11}$ is hydrogen atom or lower alkyl, a, b, c and d represent carbon atoms and one or two of them may be nitrogen atom, the carbon atom may have a substituent selected from the group consisting of hydrogen atom; halogen atom; alkyl; alkoxyl; substituted or unsubstituted amino; or nitro, a—b, b—c or c—d bond may form an another aromatic ring,

[II]

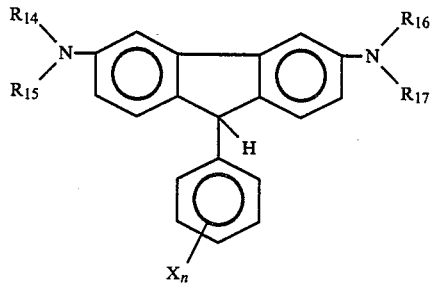

wherein $R_{14}$, $R_{15}$, $R_{16}$ and $R_{17}$ are each $C_1 \sim C_8$ saturated alkyl; $C_5 \sim C_8$ cycloalkyl; $C_3 \sim C_8$ alkoxyalkyl; aryl unsubstituted or substituted with halogen atom, $C_1 \sim C_4$ saturated alkyl or $C_1 \sim C_4$ alkoxyl; or aralkyl unsubstituted or substituted with halogen atom, $C_1 \sim C_4$ saturated alkyl or $C_1 \sim C_4$ alkoxyl; $R_{14}$ and $R_{15}$, or $R_{16}$ and $R_{17}$ may form a heteroring together therewith or with an adjacent benzene ring, X is hydrogen atom; halogen atom; $C_1 \sim C_4$ saturated alkyl; $C_1 \sim C_4$ alkoxyalkyl; or $—N(R_{18})(R_{19})$, $R_{18}$ and $R_{19}$ are each same as $R_{14}$, $R_{15}$, $R_{16}$ or $R_{17}$, n is an integer of 1 to 4,

[III]

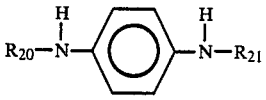

wherein $R_{20}$ and $R_{21}$ are each $C_1 \sim C_{10}$ saturated alkyl; $C_3 \sim C_9$ unsaturated alkyl; $C_5 \sim C_8$ cycloalkyl; 3-methacryloyloxy-2-hydroxypropyl; or aralkyl, aryl or arylsulfonyl unsubstituted or substituted with halogen atom, $C_1 \sim C_4$ saturated alkyl or $C_1 \sim C_4$ alkoxyl.

2. A heat-sensitive recording material as defined in claim 1 wherein the phthalide derivative is a compound of the formula [IV]

[IV]

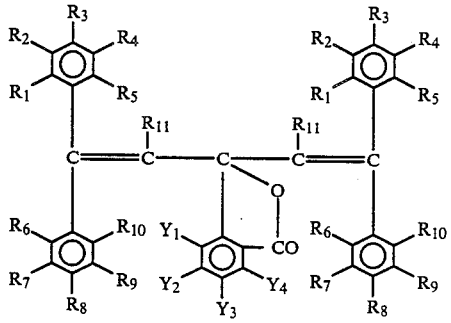

wherein $R_1$ to $R_{11}$ are same as above, $Y_1$ to $Y_4$ are each halogen atom.

3. A heat-sensitive recording material as defined in claim 2 wherein the phthalide derivative is a compound of the formula [V]

[V]

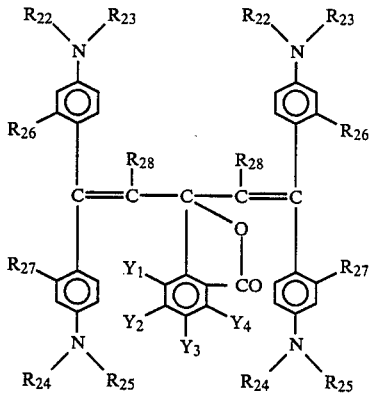

wherein $R_{22}$ to $R_{25}$ are each $C_1 \sim C_8$ saturated alkyl; $C_3 \sim C_9$ unsaturated alkyl; $C_5 \sim C_7$ cycloalkyl; $C_3 \sim C_8$ alkoxyalkyl; phenyl unsubstituted or substituted with halogen atom, $C_1 \sim C_4$ saturated alkyl or $C_1 \sim C_4$ alkoxyl; or benzyl unsubstituted or substituted with halogen atom, $C_1 \sim C_4$ saturated alkyl or $C_1 \sim C_4$ alkoxyl; $R_{22}$ and $R_{23}$, or $R_{24}$ and $R_{25}$ may form a 5- to 7-membered heteroring together therewith or with an adjacent benzene ring, $R_{26}$ and $R_{27}$ are each hydrogen atom; halogen atom; $C_1 \sim C_4$ saturated alkyl; $C_1 \sim C_4$ alkoxyalkyl; or $C_1 \sim C_4$ acyloxy, $R_{28}$ is hydrogen atom; or $C_1 \sim C_4$ saturated alkyl, $Y_1$ to $Y_4$ are same as above.

4. A heat-sensitive recording material as defined in claim 2 wherein the phthalide derivative is a compound of the formula [VI]

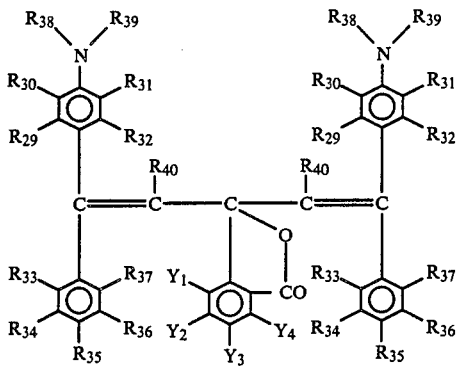

[VI]

wherein $R_{29}$ to $R_{37}$ are each hydrogen atom; halogen atom; nitro; $C_1 \sim C_4$ saturated alkyl; $C_5 \sim C_7$ cycloalkyl; $C_1 \sim C_4$ alkoxyl; $C_1 \sim C_4$ acyloxy; $C_1 \sim C_4$ thioalkoxyl; phenyl unsubstituted or substituted with halogen atom, nitro, methyl, ethyl, methoxy or ethoxy; benzyl unsubstituted or substituted with halogen atom, nitro, methyl, ethyl, methoxy or ethoxy; phenoxy unsubstituted or substituted with halogen atom, nitro, methyl, ethyl, methoxy or ethoxy; benzoyloxy unsubstituted or substituted with halogen atom, nitro, methyl, ethyl, methoxy or ethoxy; $C_1 \sim C_4$ acylamino; or benzoylamino unsubstituted or substituted with halogen atom, nitro, methyl, ethyl, methoxy or ethoxy, $R_{38}$ and $R_{39}$ are each $C_1 \sim C_8$ saturated alkyl; $C_3 \sim C_9$ unsaturated alkyl; $C_5 \sim C_7$ cycloalkyl; $C_3 \sim C_8$ alkoxyalkyl; phenyl unsubstituted or substituted with halogen atom, $C_1 \sim C_4$ saturated alkyl or $C_1 \sim C_4$ alkoxyl; or benzyl unsubstituted or substituted with halogen atom, $C_1 \sim C_4$ saturated alkyl or $C_1 \sim C_4$ alkoxyl; $R_{38}$ and $R_{39}$ may form a 5- to 7-membered heteroring together therewith or with an adjacent benzene ring, $R_{40}$ is hydrogen atom; or $C_1 \sim C_4$ saturated alkyl, $Y_1$ to $Y_4$ are same as above.

5. A heat-sensitive recording material as defined in claim 1 wherein said at least one compound is the fluorene derivative of the formula (II).

6. A heat-sensitive recording material as defined in claim 5 wherein said fluorene derivative has the formula [VII]

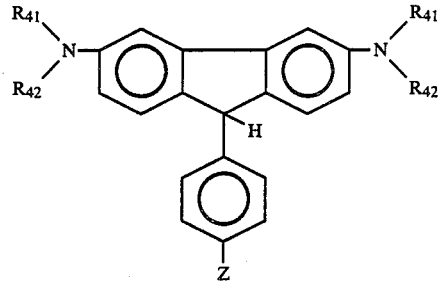

[VII]

wherein $R_{41}$ and $R_{42}$ are each $C_1 \sim C_4$ saturated alkyl, Z is hydrogen atom or $-N(R_{43})(R_{44})$, $R_{43}$ and $R_{44}$ being each $C_1 \sim C_4$ saturated alkyl.

7. A heat-sensitive recording material as defined in claim 1 wherein said at least one compound is the p-phenylenediamine derivative of the formula (III).

8. A heat-sensitive recording material as defined in claim 7 wherein said p-phenylenediamine derivative has the formula [VII]

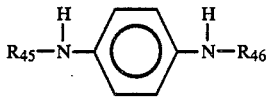

[VIII]

wherein $R_{45}$ and $R_{46}$ are each phenyl or naphthyl unsubstituted or substituted with halogen atom, $C_1 \sim C_4$ saturated alkyl or $C_1 \sim C_4$ alkoxyl.

9. A heat-sensitive recording material as defined in claim 8 wherein the compound of the formula [VII] is N,N'-di-β-naphthyl-p-phenylenediamine.

10. A heat-sensitive recording material as defined in claim 1 wherein the fluorene derivative of the formula [II] is used in an amount of 0.05 to 10 parts by weight per one part by weight of the phthalide derivative of the formula [I].

11. A heat-sensitive recording material as defined in claim 1 wherein the p-phenylenediamine derivative of the formula [III] is used in an amount of 0.05 to 10 parts by weight per one part by weight of the phthalide derivative of the formula [I].

* * * * *